US006652320B2

(12) United States Patent
Inagawa et al.

(10) Patent No.: US 6,652,320 B2
(45) Date of Patent: Nov. 25, 2003

(54) SHIELDED CABLE WITH CONNECTOR

(75) Inventors: Hideho Inagawa, Kanagawa (JP); Makoto Takayama, Kanagawa (JP); Toru Osaka, Kanagawa (JP); Tatsuo Nishino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/318,039

(22) Filed: Dec. 13, 2002

(65) Prior Publication Data

US 2003/0104728 A1 Jun. 5, 2003

Related U.S. Application Data

(62) Division of application No. 09/918,495, filed on Aug. 1, 2001.

(30) Foreign Application Priority Data

| | | |
|---|---|---|
| Aug. 4, 2000 | (JP) | 2000-236342 |
| Sep. 20, 2000 | (JP) | 2000-284448 |
| Jul. 17, 2001 | (JP) | 2001-216746 |

(51) Int. Cl.[7] ..... H01R 13/648
(52) U.S. Cl. ..... 439/610
(58) Field of Search ..... 439/610, 98

(56) References Cited

U.S. PATENT DOCUMENTS

| | | | | |
|---|---|---|---|---|
| 5,820,412 A | * | 10/1998 | Koegel et al. | 439/610 |
| 5,899,772 A | * | 5/1999 | Beaver et al. | 439/610 |
| 6,109,969 A | * | 8/2000 | Kuo et al. | 439/610 |
| 6,146,205 A | * | 11/2000 | Lai | 439/610 |
| 6,165,017 A | * | 12/2000 | Kuo | 439/610 |
| 6,231,374 B1 | * | 5/2001 | Kuo | 439/455 |

* cited by examiner

*Primary Examiner*—Gary Paumen
(74) *Attorney, Agent, or Firm*—Fitzpatrick, Cella, Harper & Scinto

(57) ABSTRACT

A shielded cable with a connector, in which the connector is connected to an end portion of the shielded cable formed by covering a plurality of cores with a shielding member, comprises an electrode portion provided with a plurality of electrodes connected to the cores, a conductive inner housing having a fitting portion for fitting to a connector which is to be fitted to the connector, and having the electrode portion therein, and a conductive outer housing which is used in combination with the inner housing and contains cores exposed from the shielded cable, wherein the outer housing is electrically connected to the shielding member, and the outer housing is electrically connected to the inner housing through a conductive connecting portion electrically connected to the fitting portion of the inner housing.

2 Claims, 15 Drawing Sheets

SHIELDED CABLE WITH CONNECTOR

This is a divisional application of application Ser. No. 09/918,495, filed Aug. 1, 2001.

BACKGROUND OF THE INVENTION

1. Field of the Invention

The present invention relates to a shielded cable with a connector obtained by fitting an end of a shielded cable used to electrically connect electronic instruments with a connector.

2. Related Background Art

Recently, with the improvement and diversification of the functions of electronic instruments, various electronic instruments such as a personal computer, a printer, etc. transmit and receive a large volume of data at a high speed between substrates of an electronic instrument, or between electronic instruments. In this connection, an increasing number of cables with multipin connectors have been used as interfaces. When such cables with multipin connectors are used in transmitting signals between electronic instruments, there often arises the problem about radiation noise and immunity. Thus, a shielded cable obtained by covering a bundle of a plurality of cores with a mesh-shaped shielding member. The shielding member suppresses radiation noise by being electrically connected to a conductive metal housing of the connector fitted to the end of the shielded cable.

In addition, the housing of the substrate side connector of the electronic instrument, which is the opposite side to the connector of the shielded cable is also a conductive metal member, and is electrically connected to the metal housing of the electronic instrument. Thus, with the housing of the shielded cable side connector fitted to the substrate side connector, and both connectors electrically connected, the shielding member of the shielded cable is electrically connected to the housing of the electronic instrument, which is the ground, through the housings of the connectors, thereby suppressing the radiation noise by the shield effect.

However, if the electric connection between the members from the shielding member of the shielded cable to the housing of the substrate side connector of the electronic instrument is incomplete, then the shield characteristic of the radiation noise largely fluctuates, thereby causing the radiation noise.

The first factor of the incomplete electric connection from the shielding member of the shielded cable to the housing of the substrate side connector of the electronic instrument can be a defective electric connection in the fitting portion between the cable side connector and the substrate side connector. Normally, the cable side connector is fitted to the substrate side connector with the fitting portion of the cable side-connector set outside while the fitting portion of the substrate side connector set inside, and with the fitting portion of the cable side connector a little extended. Therefore, the shape of the fitting portion of the cable side connector is likely to be deformed, thereby causing an incomplete connection state between the cable side connector and the substrate side connector after repeated use.

Furthermore, normally, the cable side connector is formed by an outer housing forming the exterior, and an inner housing having a fitting portion of the substrate side connector. Therefore, the second factor of the incomplete electric connection from the shielding member of the shielded cable to the housing of the substrate side connector of the electronic instrument can be a defective electric connection between the outer housing and the inner housing. The unstable state of the electric connection becomes worse by the distortion of the fitting portion of the cable side connector caused when the cable side connector is fitted to the substrate side connector.

In addition, a clamp portion for connecting and clamping to the shield portion of the shielded cable is formed at the back end portion of the outer housing. The clamp portion is formed by an elastic member having a U-shaped section. By reducing its diameter, the circumference of the shield portion of the shielded cable can be clamped. However, since the clamp portion is formed by an elastic member, it is easily deformed, thereby causing an incomplete electric connection between the shielding member provided for the shielded cable and the outer housing, which is the third factor of the incomplete electric connection from the shielding member of the shielded cable to the housing of the substrate side connector of the electronic instrument.

SUMMARY OF THE INVENTION

An object of the present invention is to eliminate the first factor of the incomplete electric connection from the shielding member of the shielded cable to the housing of the substrate side connector of an electronic instrument, and ensure and stabilize the electric connection between the fitting portion of the cable side connector and the fitting portion of the substrate side connector, with the cable side connector being fitted to the substrate side connector.

Another object of the present invention is to eliminate the second factor of the incomplete electric connection from the shielding member of the shielded cable to the housing of the substrate side connector of the electronic instrument, and to ensure and stabilize the electric connection between the inner housing and the outer housing of the cable side connector.

A further object of the present invention is to eliminate the first, second, and third factors of the incomplete electric connection from the shielding member of the shielded cable to the housing of the substrate side connector of the electronic instrument and to ensure the electric connection of all members from the shielding member of the shielded cable to the housing of the substrate side connector of the electronic instrument.

To attain the object, the present invention provides a shielded cable with a connector, in which the connector is connected to an end portion of the shielded cable formed by covering a plurality of cores with a shielding member, comprising an inner conductive housing having an electrode portion-provided with a plurality of electrodes connected to a plurality of cores, and having a fitting portion for fitting to a connector which is the opposite side of the connection; and an outer conductive housing combined with the inner housing, and containing the cores exposed from the shielded cable. The outer housing is electrically connected to the shielding member, and is electrically connected to the fitting portion of the inner housing through the conductive connecting portion which is elastically connected to the fitting portion.

Furthermore, according to the present invention, the connecting portion is made of a member different from member of the outer housing.

According to the present invention, the connecting portion has a bent portion vertical to the longitudinal direction of the inner housing, and is connected to the fitting portion of the inner housing by the elasticity of the bent portion.

According to the present invention, the connecting portion is a conductive leaf-spring-like member.

According to the present invention, the connecting portion is formed so as to contact a plurality of portions of the fitting portion of the inner housing.

According to the present invention, the connecting portion has a saw-teeth array.

According to the present invention, the connecting portion has a plurality of convex portions in the longitudinal direction of the inner housing.

Furthermore, according to the present invention, the connecting portion is further provided with a conductive connecting member inserted between the fitting portions of the outer housing and the inner housing.

According to the present invention, the connecting member has a pin array obtained by connecting a plurality of conductive metal pins parallel to each other and being incorporated into one structure.

Furthermore, according to the present invention, the connecting member is a conductive leaf spring.

In addition, according to the present invention, the connecting member is a gasket of conductive rubber.

Furthermore, the present invention is to provide a shielded cable with a connector, in which the connector is connected to an end portion of the shielded cable formed by covering a plurality of cores with a shielding member, comprising: an electrode portion provided with a plurality of electrodes connected to cores; a conductive inner housing having a fitting portion for fitting to a connector which is to be fitted to the connector, and having the electrode portion therein; and a conductive outer housing which is used in combination with the inner housing and containing cores exposed from the shielded cable, wherein the outer housing is designed to have an end portion of the shielding member inner the cable inlet provided at a back of the outer housing, and a conductive clamp portion provided at a back end of the outer housing clamps the shielding member of the shielded cable to electrically connect; and the outer housing is electrically connected to the inner housing through a conductive connecting portion elastically connected to the fitting portion of the inner housing.

Furthermore, according to the present invention, the cable inlet is electrically connected to the shielding member at a number of points.

In addition, according to the present invention, the cable inlet is formed to be a square such that the each side of the square is shorter than the diameter of the shielding member and the cable inlet is electrically connected to the shielding member at a number of points.

Additionally, according to the present invention, the cable inlet is formed such that its diameter is substantially the same in size as the diameter of the shielding member, one, or more projections are provided on the edge of the cable inlet, the cable inlet is electrically connected to the shielding member through the projections.

Furthermore, according to the present invention, the saw-teeth shaped projections are provided on the cable inlet.

DETAILED DESCRIPTION OF THE PREFERRED EMBODIMENTS

The embodiments of the present invention are described below by referring to the attached drawings.

(First Embodiment)

Figure 1:
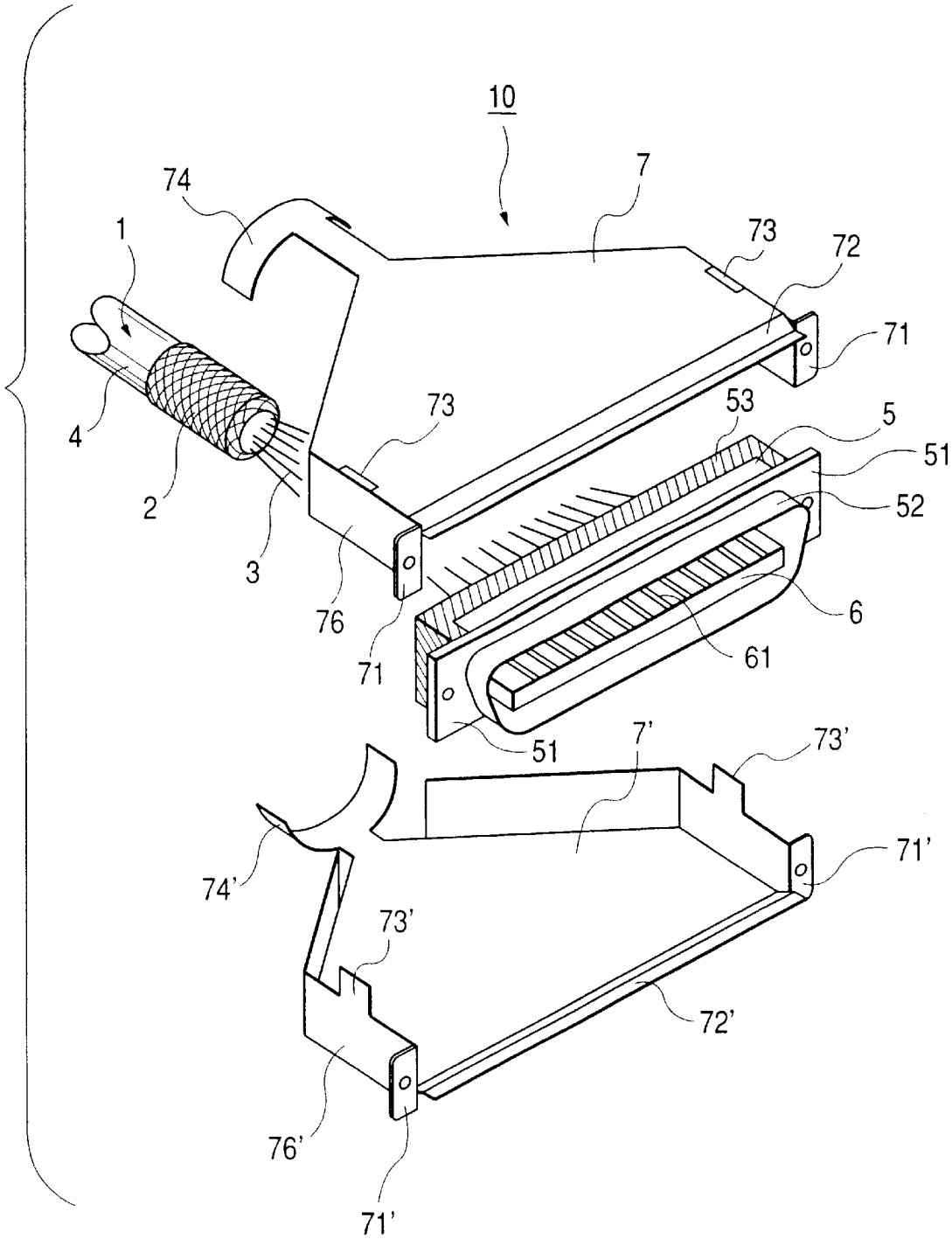
FIG. 1 is an exploded perspective view of the structure of the shielded cable with a connector according to the first embodiment of the present invention.
Figure 2:
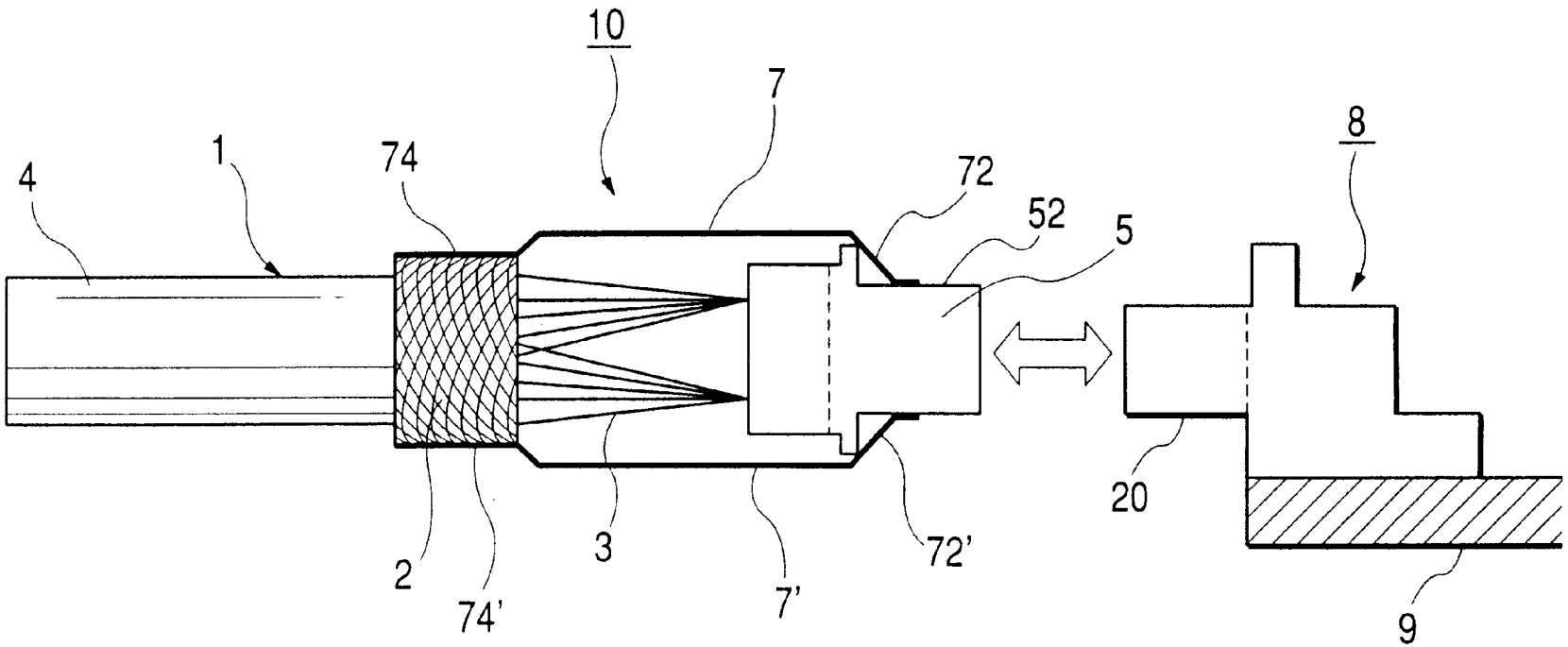
FIG. 2 is a sectional view showing the structure of the shielded cable with a connector, and a type of the connection of the connector.

FIG. 1 is an exploded perspective view showing the structure of the shielded cable with a connector according to the first embodiment of the present invention. FIG. 2 is a sectional view showing a structure of a shielded cable with a connector.

In FIG. 1, reference numeral 1 denotes a shielded cable having a bundle of a plurality of cores 3, each core covered with an insulating material, and the bundle covered with mesh-shaped metal shielding member 2. The entire shielded cable 1 is further covered with a covering 4 of an insulating material. At an end portion of the shielded cable 1, the covering 4 is removed and the shielding member 2 is folded outside. The cores 3 are exposed from the end portion of the shielded cable 1. The cores 3 are connected to a connector electrode described below by a soldering method, etc. Furthermore, a cable side connector 10 is attached to the end portion of the shielded cable 1. The cable side connector 10 comprises outer housings 7 and 7', an inner housing 5, and an electrode portion 6.

The inner housing 5 is made of conductive metal, and comprises a cable side fitting portion 52 formed in a shape of a substantially rectangular cylinder having open ends, and a flange 51 projecting up, down, right, and left. The cable side fitting portion 52 is fitted to a substrate side fitting portion 20 of a substrate side connector 8 provided on a printed board 9 of the electronic instrument which is to be connected to the cable side connector 10 as shown in FIG. 2. At the fitting portion, the cable side fitting portion 52 fits to the substrate side fitting portion 20 such that the cable side fitting portion 52 is positioned outside and the substrate side fitting portion 20 inside. For complete fitting, the inner diameter of the cable side fitting portion 52 is smaller than the outer diameter of the substrate side fitting portion 20. When they are fitted to each other, force is applied to extend the cylindrical portion of the cable side fitting portion 52.

The connector electrode portion 6 is fixed in the inner housing 5. In the connector electrode portion 6, a plurality of electrode connection terminals 61 connected to the respective cores 3 are held by a holding member 53 made of an insulating material. By connecting the connector electrode portion 6 to the substrate side connector 8 provided on the printed board 9, signals from the shielded cable 1 can be transmitted to the printed board 9, and signals from the printed board 9 are transmitted to other printed board, electronic unit, and electronic instrument through the shielded cable 1.

The outer housings 7 and 7' are conductive members respectively made of metal panels formed into a single structure. By overlapping one on the other, the cable side connector 10 can be formed. A slit-shaped through-hole 73 is formed at the left and right ends of the upper outer housing 7. On the left and right side walls of the lower outer housing 7', thin plate projections 73' are formed in the positions corresponding to the slit-shaped penetration hole 73. By inserting the projection 73' into-the through-hole 73 and bending it inward, the outer housing 7 and the outer housing 7' can be firmly fixed. The outer housing member 7 is inside the lower outer housing 7' and fixed. The outer housings 7 and 7' contains the folded portion of the shielding member 2 at the end portion of the shielded cable 1 to the cores 3 exposed from the end portion, and the inner housing 5 is attached to the front portions of the outer housings 7 and 7'.

The outer housings 7 and 7' are approximately pentagonal like a home plate. On the left and right sides, side walls 76 and 76' are folded to have the height corresponding to the height of the inner housing 5. At the front ends of the side walls 76 and 76', flanges 71 and 71' are bent outside into the L shape. Holes are made for screws in the flange 51 of the inner housing 5 and the flanges 71 and 71' of the outer housings 7 and 7'. These holes are arranged in order with the outer housings 7 and 7' combined together. The screws (not shown) for use in fixing the cable side connector 10 to the substrate side connector 8 are inserted into the arranged holes.

At the back end portions of the home plate shaped portion of the outer housings 7 and 7', substantially semicylindrical, elastic, transformable, and conductive clamp portions 74 and 74' for clamping and holding the folded portion of the shielding member 2 are formed in the shielded cable 1. By making smaller radii of the clamp portions 74 and 74' with the outer housings 7 and 7' combined together, the shielded cable 1 can be held and fixed by the clamp portions 74 and 74'. The clamp portions 74 and 74' do not overlap each other by having different lengths of combination between the clamp portions 74 and 74' and the outer housings 7 and 7'. Thus, the clamp portions 74 and 74' can be pressed to the folded portion of the shielding member 2, thereby electrically connecting the shielding member 2 to the outer housings 7 and 7'.

In addition, along the front edge portion opposing to the cable side fitting portion 52 of the inner housing 5 in the outer housings 7 and 7', bent portions 72 and 72' bent vertical to the longitudinal direction of the inner housing 5 are formed. By pressing with elasticity the bent portions 72 and 72' respectively to the upper and lower surfaces of the cable side fitting portion 52 of the inner housing 5, the outer housings 7 and 7' can be electrically connected to the inner housing 5. By the bent portions 72 and 72', the mechanical strength of the cable side fitting portion 52 can be increased when the cable side connector 10 is fitted to the substrate side connector 8. Therefore, the extending deformation by the fitting of the cable side fitting portion 52 with the substrate side fitting portion 20 can be reduced, thereby stabilizing the electric connection between the cable side connector 10 and the substrate side connector 8. The housing of the substrate side connector 8 can be connected to the metal housing as the ground of the electronic instrument (not shown).

The bent portions 72 and 72' can maintain the connection all the time with the inner housing 5 even if the cable side fitting portion 52 is deformed slightly in the direction of extension by the fitting with the substrate side connector 8 by the elasticity to the cable side fitting portion 52.

Furthermore, it is desired that the contact portion where the bent portions 72 and 72' and the inner housing 5 contact each other can be larger because the larger the contact portion, the less impedance of the entire connector, thereby suppressing the generation of radiation noise. In addition, since the space between the outer housings 7 and 7' and the inner housing 5 can be small enough, the radiation noise leakage from the space can also be reduced.

Thus, the shielded cable connector according to the present embodiment can simultaneously ensure the complete and stable electric connections between the inner housing 5 and the housing of the substrate side connector 8, and between the inner housing 5 and the outer housings 7 and 7' with the connector connected to the substrate side connector 8 provided on the printed board 9 of the electronic instrument. Therefore, the shielding member 2 can be electrically connected to the metal housing of the electronic instrument through the cable side connector 10 and the substrate side connector 8, thereby obtaining the shield effect of the shielded cable 1. In addition, the waveform of signals transmitted through the shielded cable 1 can be stabilized, and the radiation noise emitted from the shielded cable 1 as an antenna can be constantly reduced at a lower level.

Although drawings are omitted in the present embodiment, a resin connector housing may be provided outside the outer housings 7 and 7' to cover the outer housings 7 and 7'. In this case, the entire outer housings 7 and 7' and the shielding member 4 are normally contained completely.

(Second Embodiment)

Figure 3:
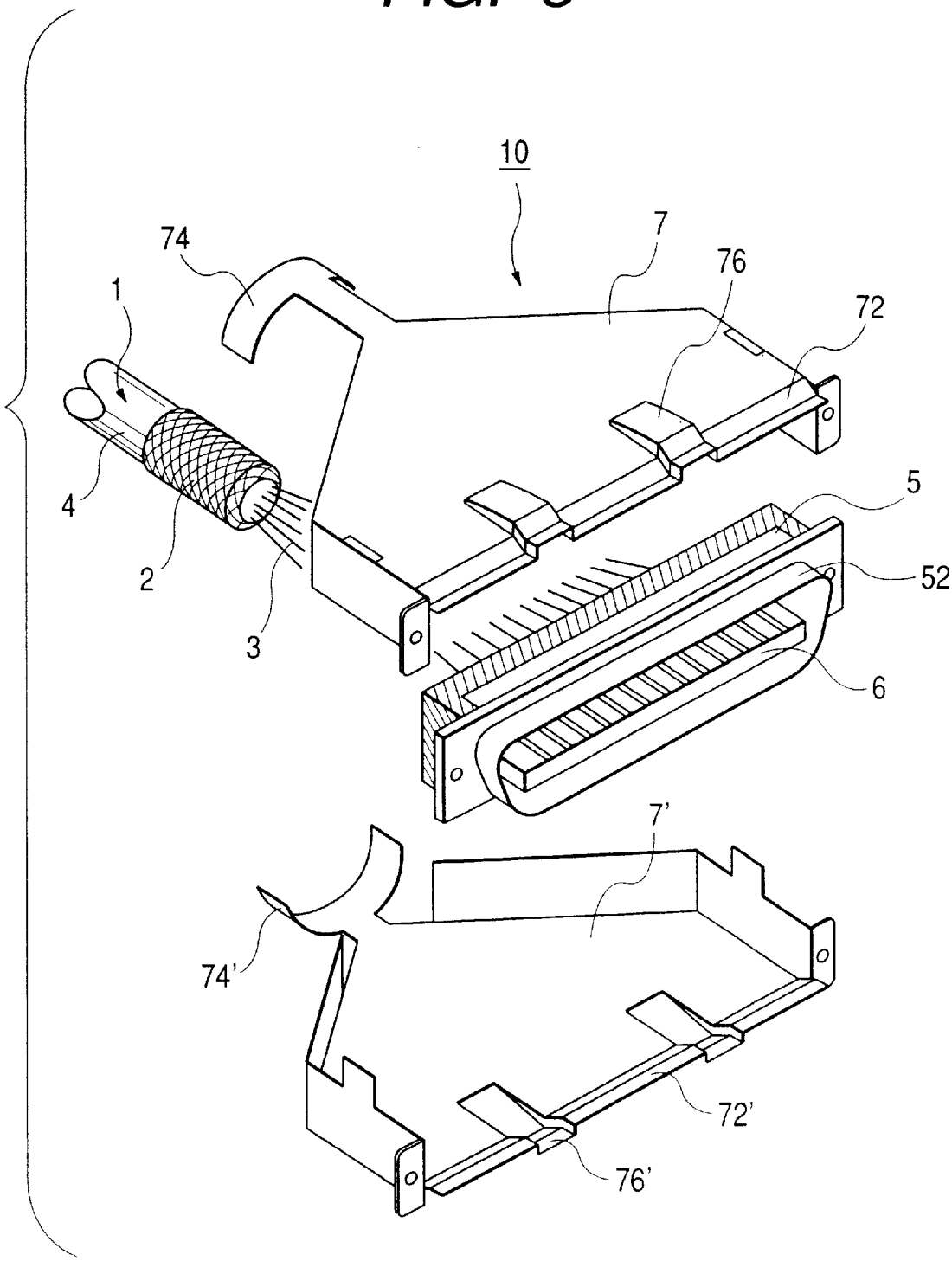
FIG. 3 is an exploded perspective view of the structure of the shielded cable with a connector according to the second embodiment of the present invention.
Figure 4:
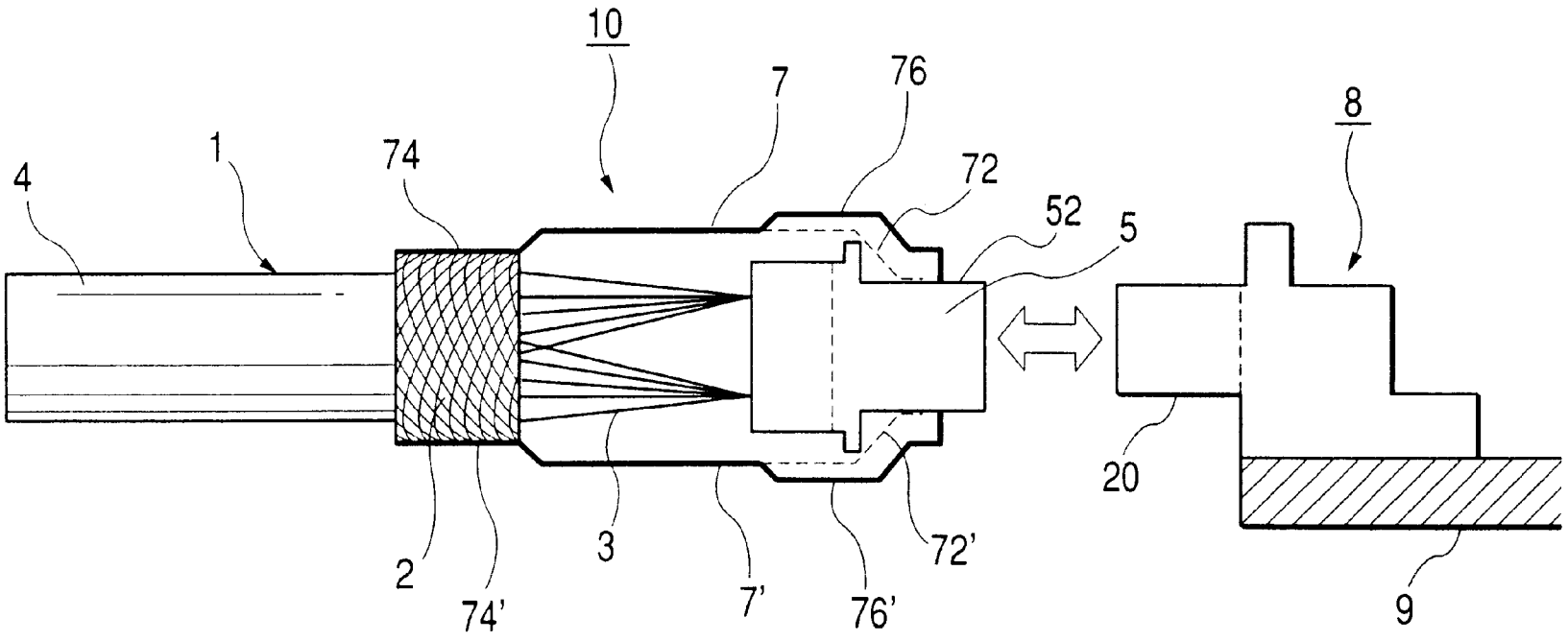
FIG. 4 is a sectional view showing the structure of the shielded cable with a connector, and a type of the connection of the connector.

FIG. 3 is an exploded perspective view showing the structure of the shielded cable with a connector according to the second embodiment of the present invention. FIG. 4 is a sectional view showing a type of the connection of the connector. The portions common with or corresponding to the portions shown in FIGS. 1 and 2 according to the first embodiment are assigned common reference numerals, and the explanation of the common portions between the first and second embodiments is omitted here.

According to the present embodiment as shown in FIGS. 3 and 4, two convex portions 76 and 76' each projecting outside are provided on the upper and lower surfaces of the bent portions 72 and 72' at the front edge of the outer housings 7 and 7'. The convex portions 76 and 76' divide the connecting portions between the bent portions 72 and 72' and the cable side fitting portion 52 of the inner housing 5 into three portions on the upper and lower surfaces at the front edge of the outer housings 7 and 7'. Since the contact length in the longitudinal direction with the inner housing 5 of the bent portions 72 and 72' becomes short by the convex portions 76 and 76', the mechanical strength and rigidity of the bent portions 72 and 72' can be reinforced. According to the present embodiment, the convex portions 76 and 76' are provided at two points each on the upper and lower surfaces, but the number of them is not limited, that is, more than one each of them may be provided.

With the structure according to the present embodiment, the suppressing force of the bent portions 72 and 72' holding the deformation of the cable side fitting portion 52 can be made larger than in the first embodiment when the cable side fitting portion 52 is fitted to the-substrate side fitting portion 20 to connect the cable side connector 10 to the substrate side connector 8 of the opposite side of the connection. Therefore, the stability of the electric connection between the cable side connector 10 and the substrate side connector 8 can be further improved.

Since the bent portions 72 and 72' are pressed at plural points along the width of the cable side fitting portion 52 for each of the upper and lower surfaces of the cable side fitting portion 52 of the inner housing 5, the problem of the unstableness of the electric connection by the one-side contact between the bent portions 72 and 72' with the cable side fitting portion 52 can be solved. Furthermore, since the deformation of the bent portions 72 and 72' themselves can also be reduced, the stability of the electric connection between the outer housings 7 and 7' and the inner housing 5 can be improved.

(Third Embodiment)

Figure 5:
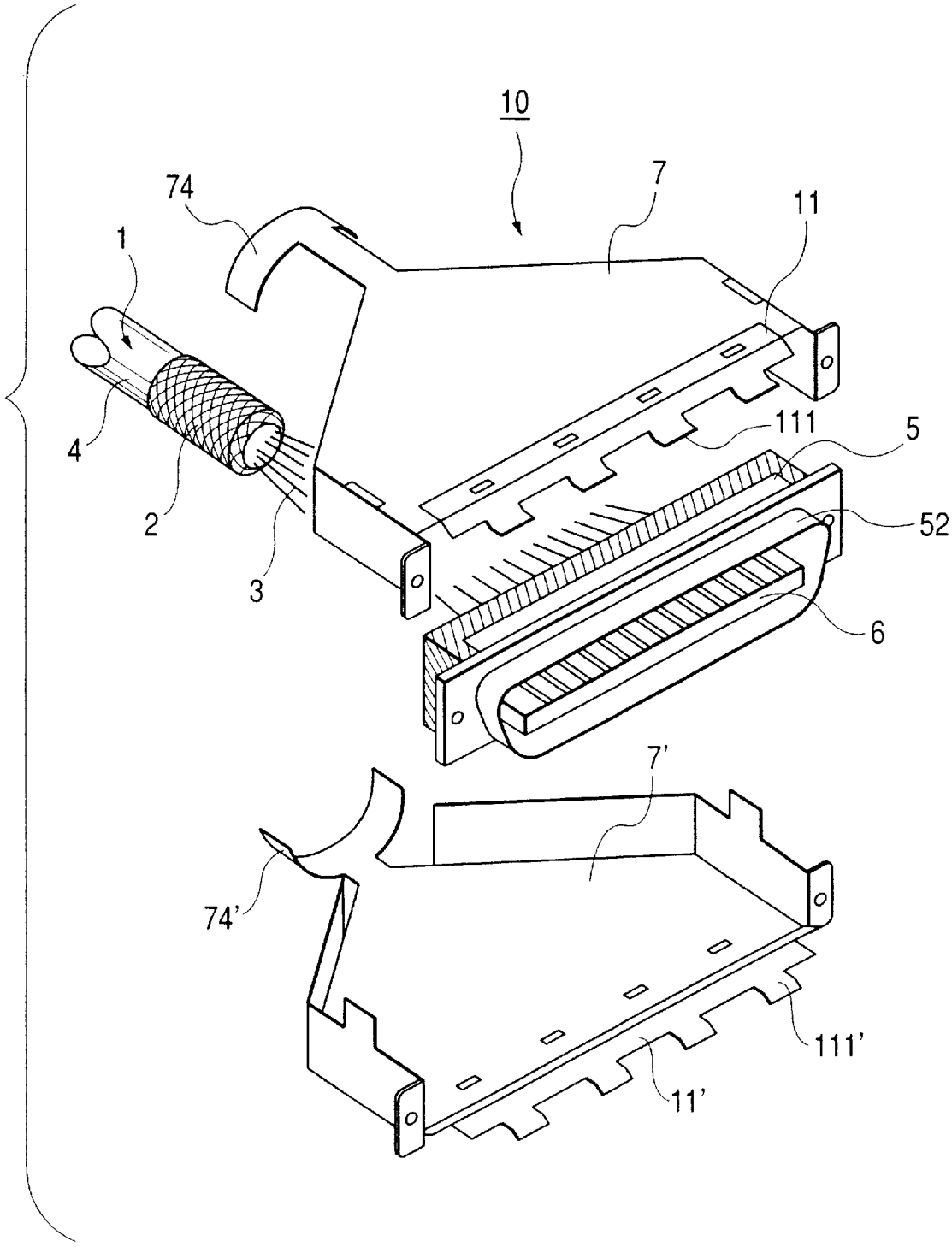
FIG. 5 is an exploded perspective view of the structure of the shielded cable with a connector according to the third embodiment of the present invention.
Figure 6:
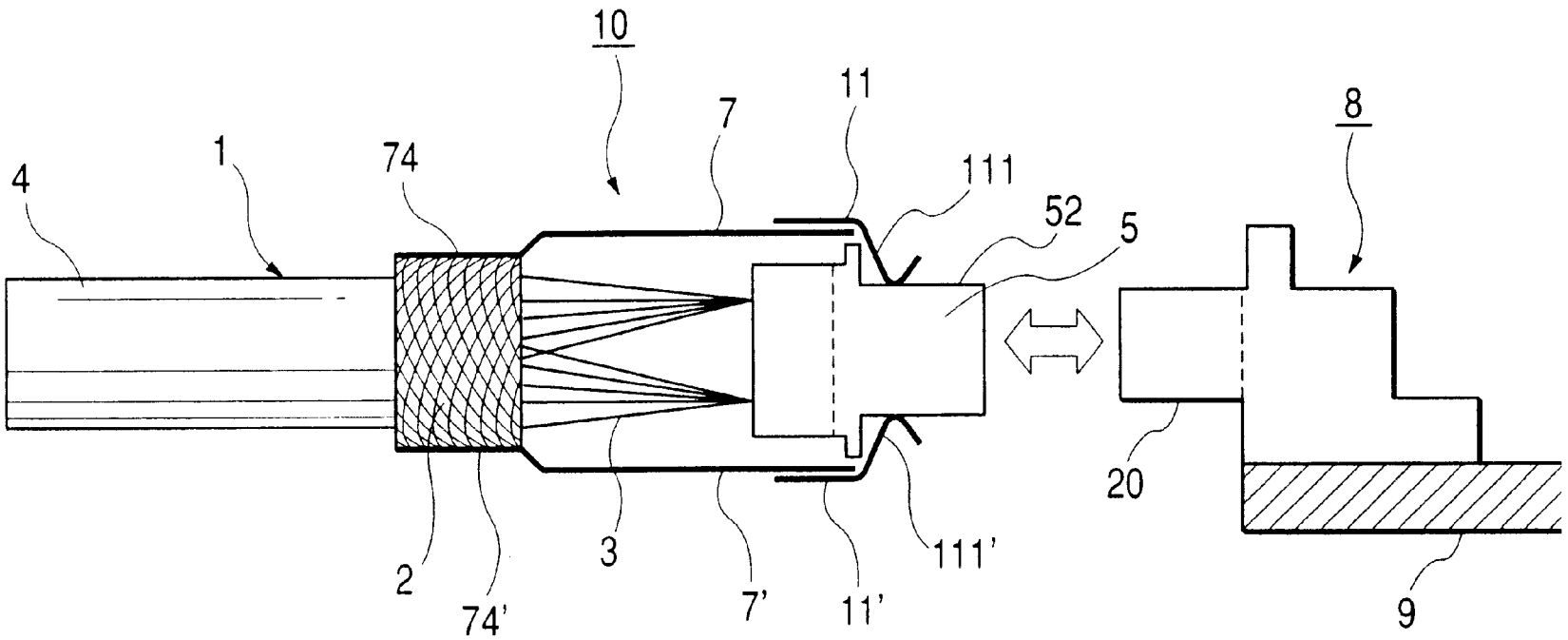
FIG. 6 is a sectional view showing the structure of the shielded cable with a connector, and a type of the connection of the connector.

FIG. 5 is an exploded perspective view showing the structure of the shielded cable with a connector according to the third embodiment of the present invention. FIG. 6 is a sectional view showing a type of the connection of the connector. The portions common with or corresponding to the portions shown in FIGS. 1 and 2 according to the first embodiment are assigned common reference numerals, and the explanation of the common portions between the first and second embodiments is omitted here.

According to the present embodiment as shown in FIGS. 5 and 6, leaf-spring-like connecting members 11 and 11' of conductive metal plate formed separate from the outer housings 7 and 7' are attached to each of the outer housings 7 and 7' by means of welding, adhesion, etc. along the front edge opposing to the cable side fitting portion 52 of the inner housing 5. The connecting members 11 and 11' are bent inward the outer housings 7 and 7', and furthermore a plurality of arc-curved teeth 111 and 111' are formed at predetermined intervals in the longitudinal direction.

With the structure according to the third embodiment, the outer housings 7 and 7' can be completely and electrically connected to the inner housing 5, the mechanical strength of the cable side fitting portion 52 can be reinforced, and its deformation can be suppressed by firmly pressing the teeth 111 and 111' of the connecting members 11 and 11' to each of the upper and lower surfaces of the cable side fitting portion 52 of the inner housing 5 with elasticity at a plurality of points with the outer housings 7 and 7' coupled as shown in FIG. 6.

According to the present embodiment, as compared with the first embodiment, the connecting members 11 and 11' are formed by a different member from the outer housings 7 and 7'. Therefore, the connecting members 11 and 11' can be easily replaced when they are damaged or the elasticity changes with time, thereby extending the durability of the cable.

(Fourth Embodiment)

Figure 7:
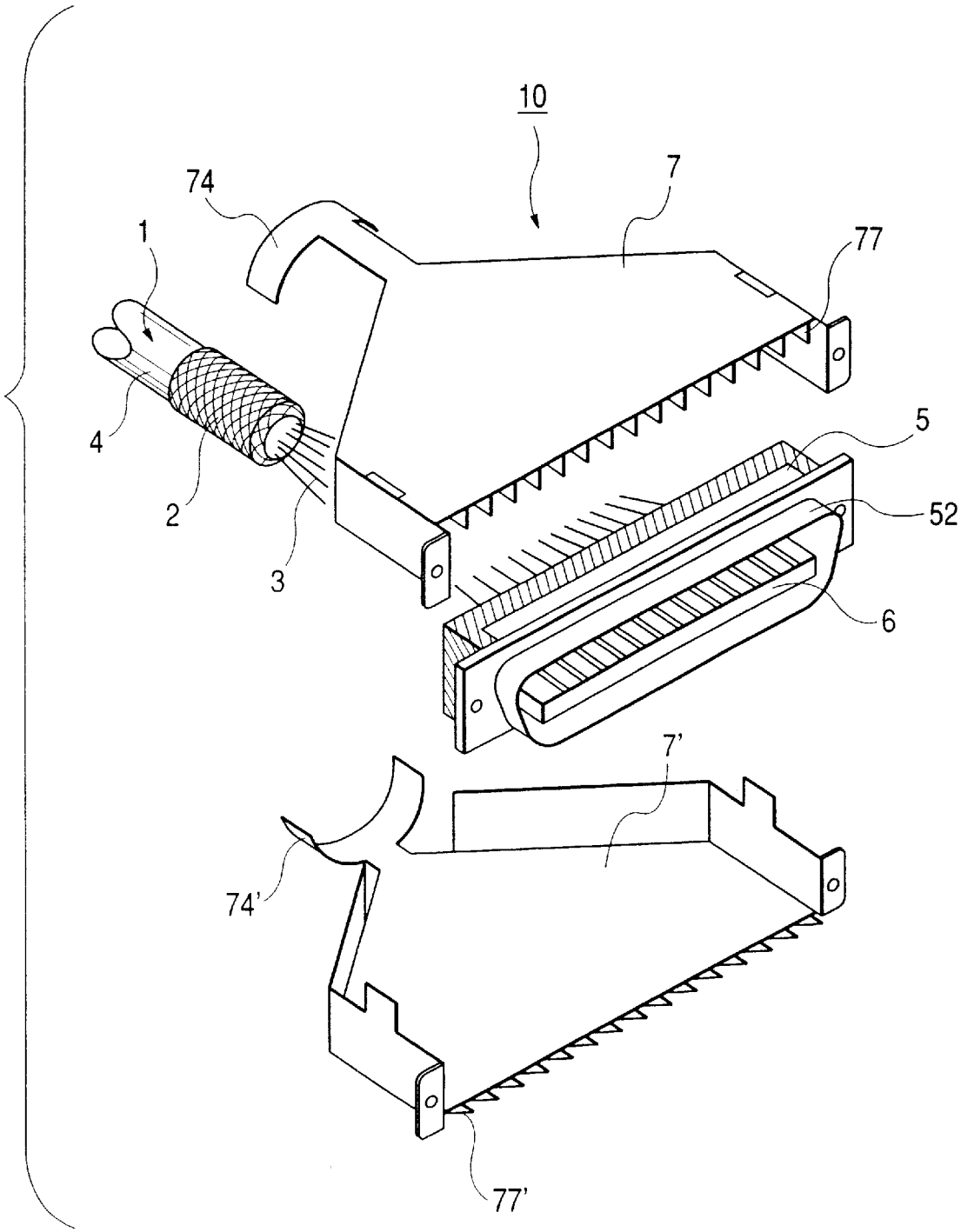
FIG. 7 is an exploded perspective view of the structure of the shielded cable with a connector according to the fourth embodiment of the present invention.
Figure 8:
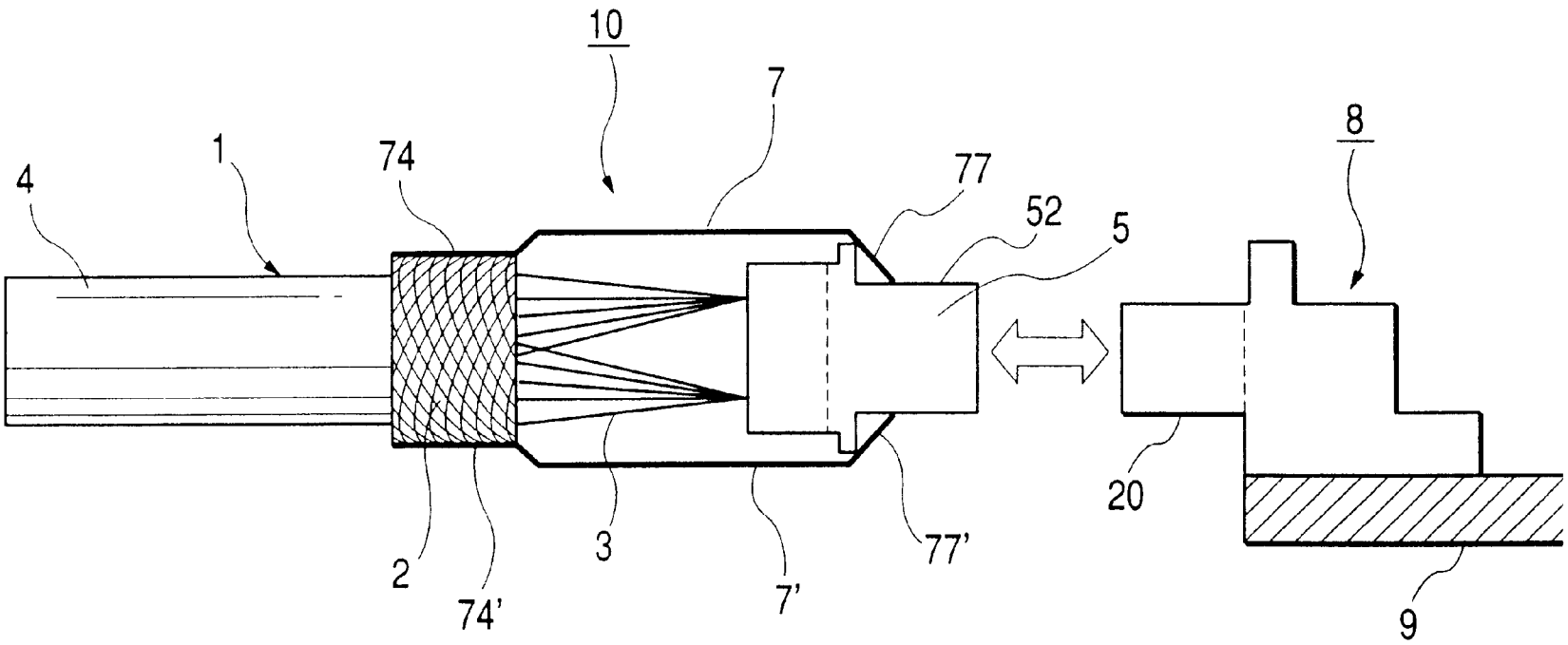
FIG. 8 is a sectional view showing the structure of the shielded cable with a connector, and a type of the connection of the connector.

FIG. 7 is an exploded perspective view showing the structure of the shielded cable with a connector according to the fourth embodiment of the present invention. FIG. 8 is a sectional view showing a type of the connection of the connector. The portions common with or corresponding to the portions shown in FIGS. 1 and 2 according to the first embodiment are assigned common reference numerals, and the explanation of the common portions between the first and second embodiments is omitted here.

According to the present embodiment as shown in FIGS. 7 and 8, saw-teeth shaped bent portions 77 and 77' bent inward the outer housings 7 and 7' are formed along the front edge of each of the outer housings 7 and 7'.

With the structure according to the fourth embodiment of the present invention, the outer housings 7 and 7' can be completely and electrically connected to the inner housing 5, the mechanical strength of the cable side fitting portion 52 can be reinforced, and its deformation can be suppressed by firmly pressing the bent portions 77 and 77' of the outer housings 7 and 7' to each of the upper and lower surfaces of the cable side fitting portion 52 of the inner housing 5 with elasticity at a plurality of points with the outer housings 7 and 7' coupled as shown in FIG. 8.

According to the present embodiment, as compared with the first embodiment, the bent portions 77 and 77' of the outer housings 7 and 7' are saw-teeth shaped and have pointed tips. Therefore, although the surface of the cable side fitting portion 52 of the inner housing 5 provides a bad circuit by the oxide film or oil film formed on it, the tips of the bent portions 77 and 77' cut the film and successfully contact the metal portions of the cable side fitting portion 52, thereby ensuring the circuit.

The form of the bent portions 77 and 77' having saw-teeth shaped pointed tips according to the present embodiment may also be adopted as variations of the second and third embodiments of the present invention.

(Fifth Embodiment)

Figure 9:
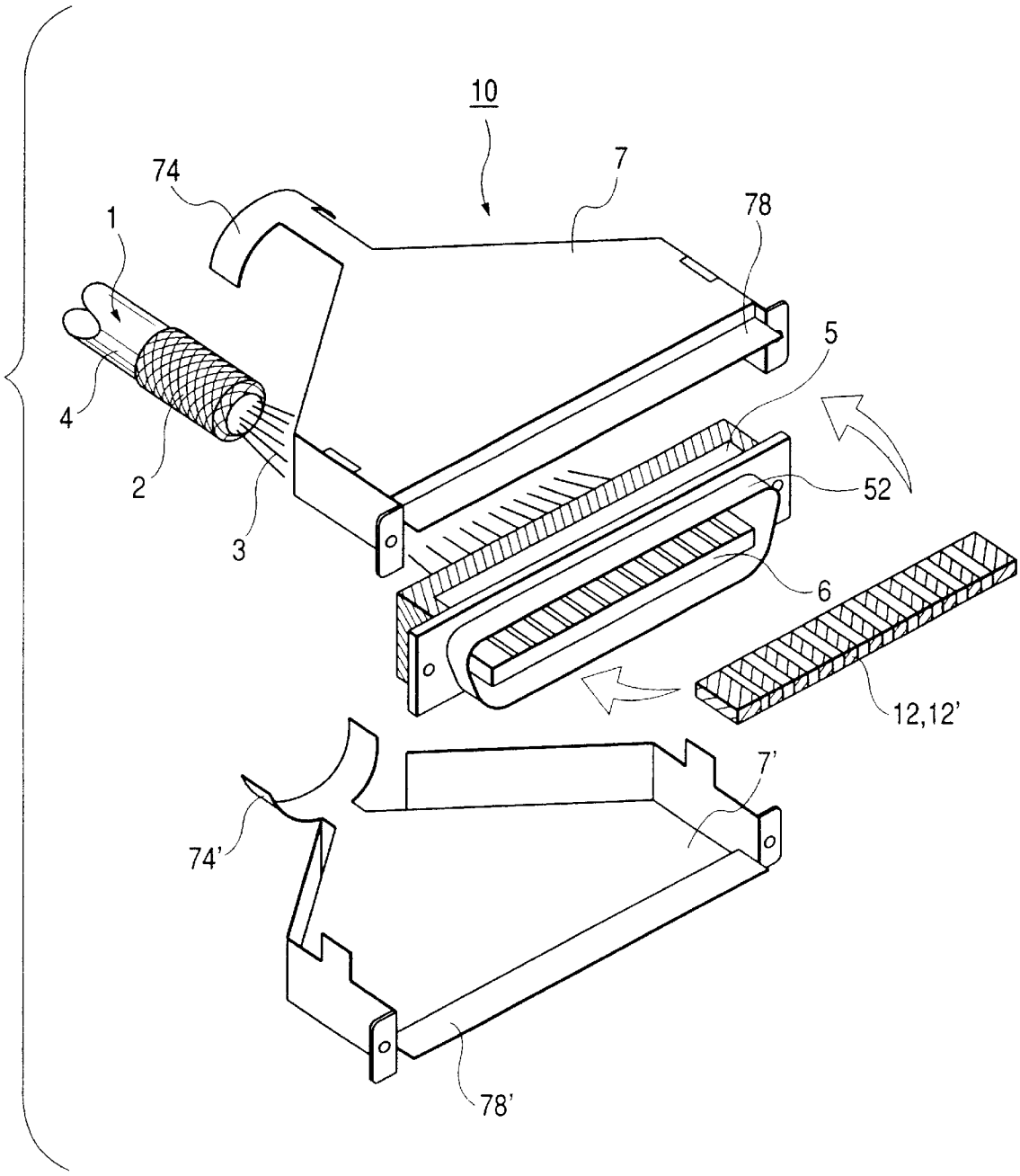
FIG. 9 is an exploded perspective view of the structure of the shielded cable with a connector according to the fifth embodiment of the present invention.
Figure 10:
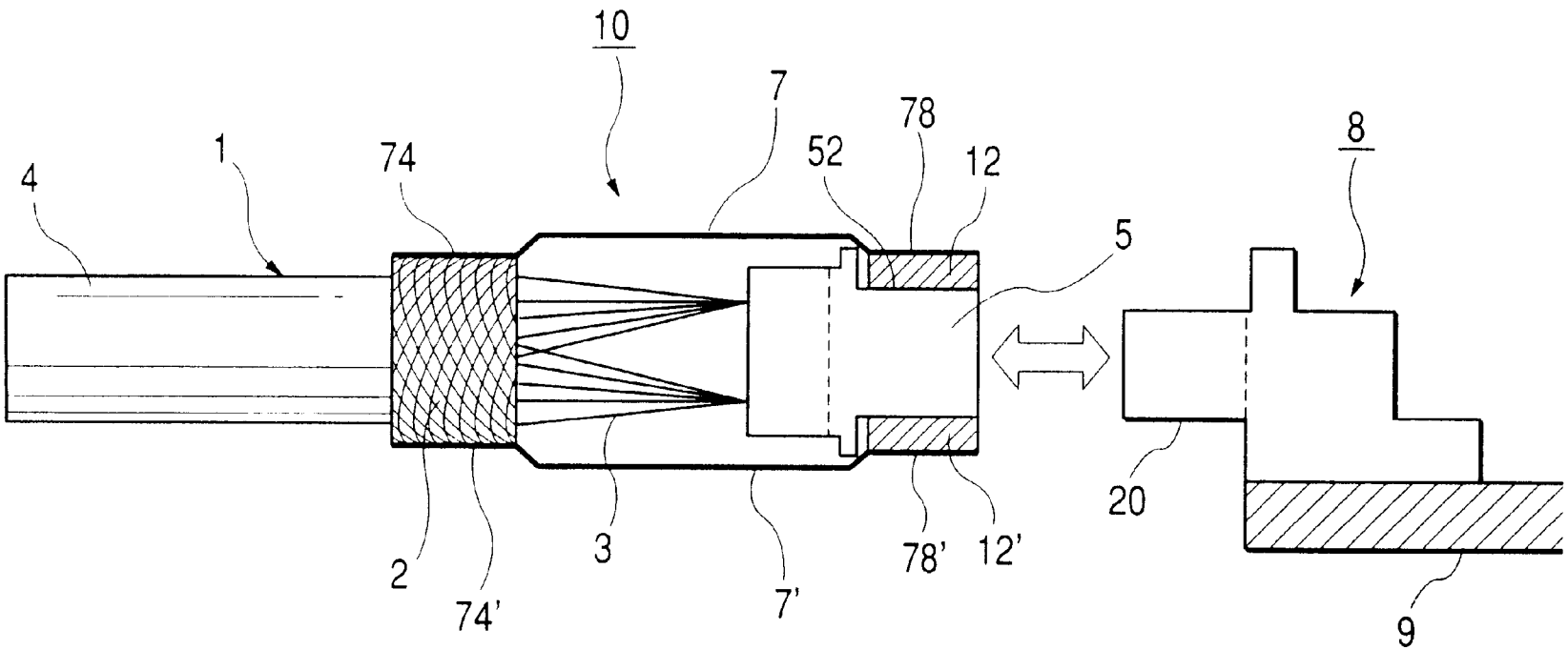
FIG. 10 is a sectional view showing the structure of the shielded cable with a connector, and a type of the connection of the connector.

FIG. 9 is an exploded perspective view showing the structure of the shielded cable with a connector according to the fifth embodiment of the present invention. FIG. 10 is a sectional view showing a type of the connection of the connector. The portions common with or corresponding to the portions shown in FIGS. 1 and 2 according to the first embodiment are assigned common reference numerals, and the explanation of the common portions between the first and second embodiments is omitted here.

According to the present embodiment as shown in FIGS. 9 and 10, bent portions 78 and 78' bent in the direction vertical to the longitudinal direction of the inner housing 5 are formed along the front edge of the outer housings 7 and 7' opposing to the cable side fitting portion 52 of the inner housing 5. The bent portions 78 and 78' are bent at smaller angles than the bent portions 72 and 72' according to the first embodiment. Connecting members 12 and 12' are inserted between the upper and lower surfaces of the cable side fitting portion 52 of the inner housing 5 and the bent portions 78 and 78' of the outer housings 7 and 7'. The connecting members 12 and 12' are pin-array members incorporated into one structure with a plurality of conductive metal pins in parallel using resin, etc., and have sufficient rigidity. The connecting members 12 and 12' are the same as each other and commonly used. Only one of them is shown in FIG. 9, but they are respectively provided on the upper and lower surfaces.

According to the present embodiment, as compared with the first through fourth embodiments, the mechanical strength of the cable side fitting portion 52 is further reinforced and the deformation can be suppressed. Therefore, the stability of the electric connection between the cable side connector 10 and the substrate side connector 8 can be improved.

By designing the connecting members 12 and 12' in a pin array, an electric connection can be made at a plurality of points along the longitudinal direction of and opposing to the upper and lower surfaces of the cable side fitting portion 52 of the inner housing 5. Therefore, the problem of the unstableness in electric connection by one-side contact can also be solved.

The connecting members 12 and 12' in the pin array according to the present embodiment can also be adopted as variations of the second and fourth embodiments of the present invention.

(Sixth Embodiment)

Figure 11:
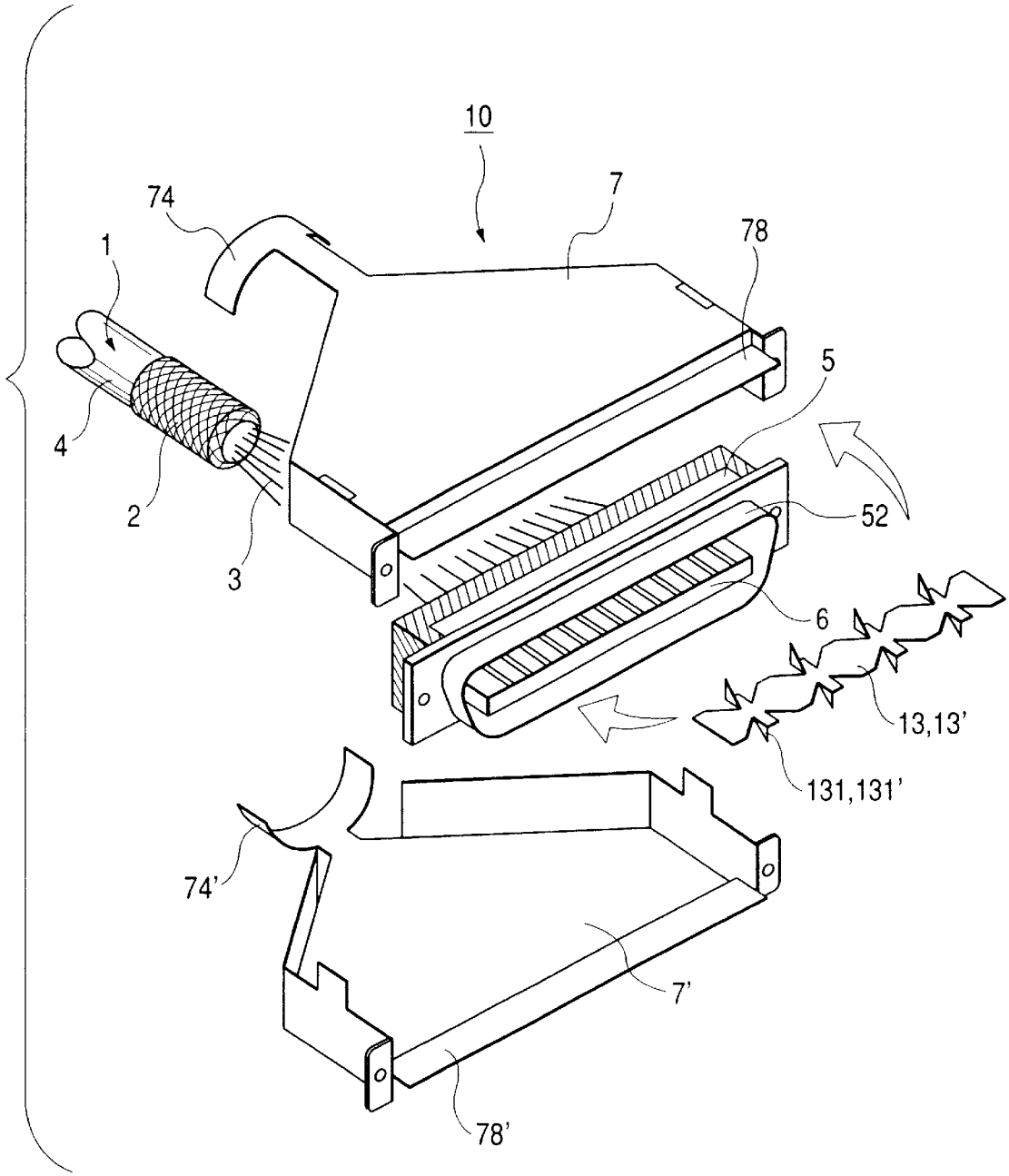
FIG. 11 is an exploded perspective view of the structure of the shielded cable with a connector according to the sixth embodiment of the present invention.
Figure 12:
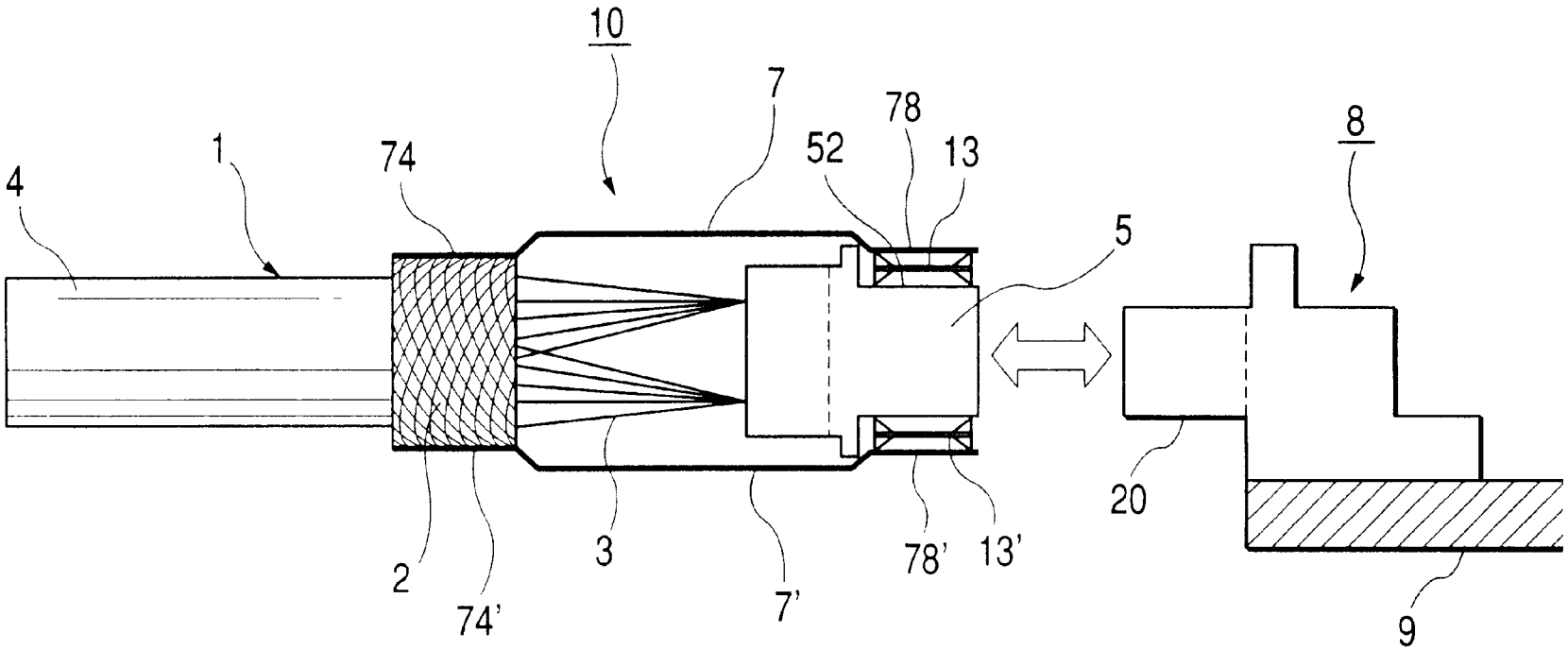
FIG. 12 is a sectional view showing the structure of the shielded cable with a connector, and a type of the connection of the connector.

FIG. 11 is an exploded perspective view showing the structure of the shielded cable with a connector according to the sixth embodiment of the present invention. FIG. 12 is a sectional view showing a type of the connection of the connector. The portions common with or corresponding to the portions shown in FIGS. 1 and 2 according to the first embodiment are assigned common reference numerals, and the explanation of the common portions between the first and second embodiments is omitted here.

According to the present embodiment, as shown in FIGS. 11 and 12, as in the fifth embodiment, bent portions 78 and 78' bent in the direction vertical to the longitudinal direction of the inner housing 5 are formed along the front edge of the outer housings 7 and 7'. Connecting members 13 and 13' are inserted between the upper and lower surfaces of the cable side fitting portion 52 of the inner housing 5 and the bent portions 78 and 78' of the outer housings 7 and 7'. The connecting members 13 and 13' are leaf-spring-like members made of conductive metal plate, and have projections 131 and 131' bent up and down in places. The connecting members 13 and 13' are the same as each other and commonly used. Only one of them is shown in FIG. 11, but they are respectively provided on the upper and lower surfaces.

According to the present embodiment, the bent portions 78 and 78' press the connecting members 13 and 13' inward with elasticity with the outer housings 7 and 7' coupled, and the connecting members 13 and 13' are firmly pressed to the upper and lower surfaces of the cable side fitting portion 52 of the inner housing 5. Thus, although the cable side fitting portion 52 is deformed when the cable side fitting portion 52 of the inner housing 5 is fitted to the substrate side connector 8, the bent portions 78 and 78' are deformed to follow the deformation of the cable side fitting portion 52, thereby ensuring a stable electric connection. Furthermore, since the mechanical strength of the cable side fitting portion 52 can be reinforced, the cable side fitting portion 52 suppresses the deformation, and the stable and complete fitting between the cable side fitting portion 52 and the substrate side connector 8 can be ensured.

The leaf-spring connecting members 13 and 13' according to the present embodiment can also be adopted as variations according to the second through fourth embodiments.

(Seventh Embodiment)

Figure 13:
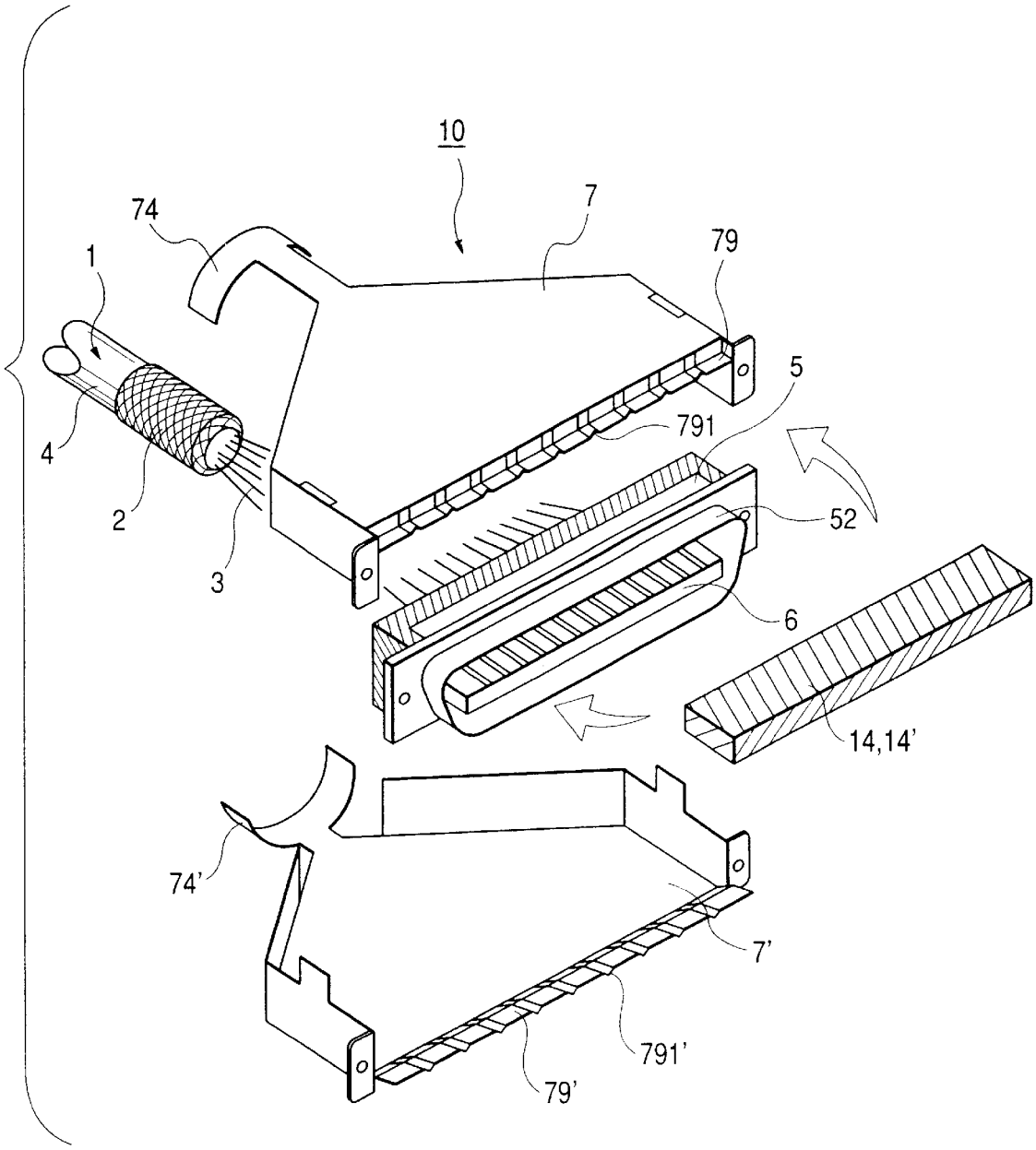
FIG. 13 is an exploded perspective view of the structure of the shielded cable with a connector according to the seventh embodiment of the present invention.
Figure 14:
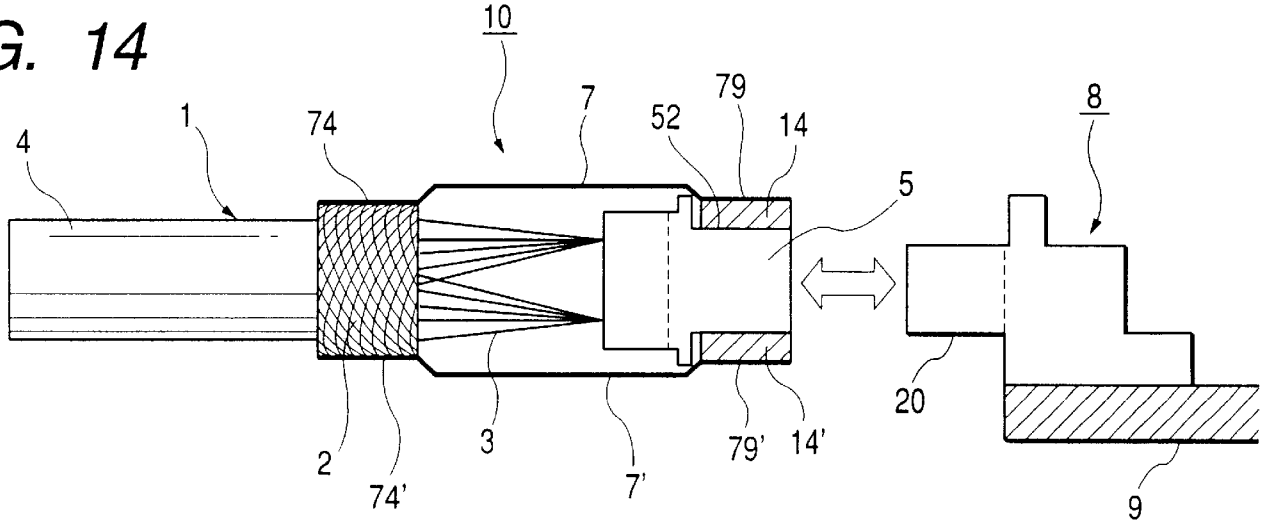
FIG. 14 is a sectional view showing the structure of the shielded cable with a connector, and a type of the connection of the connector.

FIG. 13 is an exploded perspective view showing the structure of the shielded cable with a connector according to the seventh embodiment of the present invention. FIG. 14 is a sectional view showing a type of the connection of the connector. The portions common with or corresponding to the portions shown in FIGS. 1 and 2 according to the first embodiment are assigned common reference numerals, and the explanation of the common portions between the first and second embodiments is omitted here.

According to the present embodiment as shown in FIGS. 13 and 14, convex portions 791 and 791' each projecting outside are provided at constant intervals on the upper and lower surfaces of the bent portions 79 and 79' at the front edge of the outer housings 7 and 7'. The convex portions 791 and 791' divide the connecting portions between the bent portions 79 and 79' and the cable side fitting portion 52 of the inner housing 5 into plural portions on the upper and lower surfaces at the front edge of the outer housings 7 and 7'. Since the contact length in the longitudinal direction with the inner housing 5 of the bent portions 79 and 79' becomes short by the convex portions 791 and 791', the mechanical strength and rigidity of the bent portions 79 and 79' can be reinforced. Furthermore, gaskets 14 and 14' as conductive rubber connecting members are inserted between the upper and lower surfaces of the cable side fitting portion 52 of the inner housing 5 and bent portions 79 and 79'. The gaskets 14 and 14' are the same as each other and commonly used only one of them is shown in FIG. 13, but they are respectively provided on the upper and lower surfaces.

With the structure according to the present embodiment, the bent portions 79 and 79' press the gaskets 14 and 14' inward with elasticity with the outer housings 7 and 7' coupled, and the gaskets 14 and 14' are firmly pressed to the upper and lower surfaces of the cable side fitting portion 52 of the inner housing 5. Thus, the outer housings 7 and 7' are electrically connected to the inner housing 5, the mechanical strength of the fitting portion 52 can be reinforced, and its deformation can be reduced. Therefore, although the cable side fitting portion 52 is deformed when the cable side fitting portion 52 of the inner housing 5 is fitted to the substrate side connector 8, the bent portions 79 and 79' are deformed to follow the deformation of the cable side fitting portion 52, thereby ensuring a stable electric connection. Furthermore, since the mechanical strength of the cable side fitting portion 52 can be reinforced, the cable side fitting portion 52 suppresses the deformation, and the stable and complete fitting between the cable side fitting portion 52 and the substrate side connector 8 can be ensured.

The gaskets 14 and 14' according to the present embodiment can also be adopted as variations according to the second through fourth embodiments.

(Eighth Embodiment)

Figure 15:
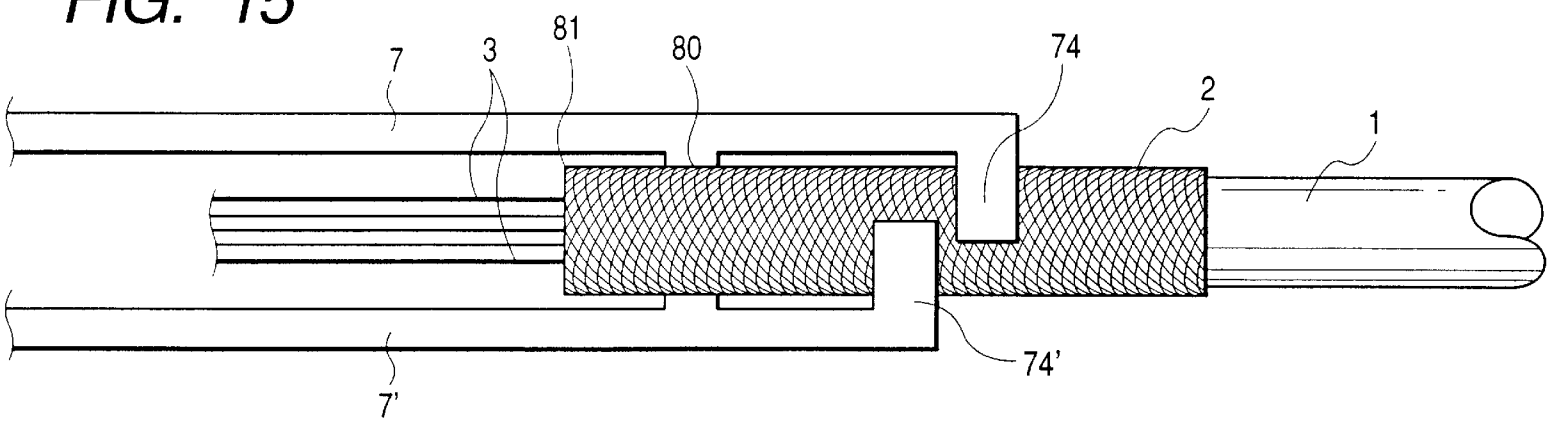
FIG. 15 is a sectional view of the structure of a connection between the shielded cable and a connector of the shielded cable with the connector according to the eighth embodiment of the present invention.
Figure 16:
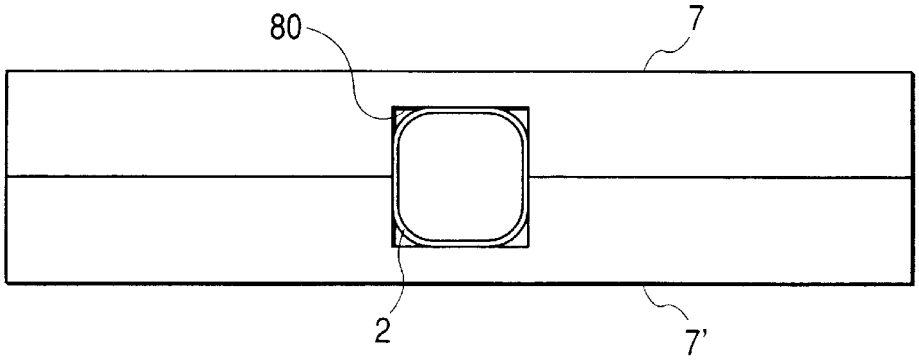
FIG. 16 is a back view of the configuration of the cable inlet portion of the shielded cable with a connector according to the eighth embodiment of the present invention.

FIGS. 15 and 16 are views of the structure of a connecting portion between the outer housing of the shielded cable with a connector and the shielded cable according to the eighth embodiment of the present invention. The portions common with or corresponding to the portions shown in FIGS. 1 and 2 according to the first embodiment are assigned common reference numerals, and the explanation of the common portions between the first and second embodiments is omitted here.

According to the present embodiment, in addition to the first through seventh embodiments, the connection between the shielded cable 1 and the outer housings 7 and 7' is completely made, and the electric connection state between members from the shielding member 2 of the shielded cable 1 to the housing of the substrate side connector 8 of an electronic instrument is completed.

In FIG. 15, clamp portions 74 and 74' for clamping the shielded cable 1 is formed as a single incorporated structure at the back end of the outer housings 7 and 7'. A cable inlet 80 for introducing the shielded cable 1 is formed at the base portion of the clamp portions 74 and 74' extending from the outer housings 7 and 7'.

The clamp portions 74 and 74' clamp and hold the shielding member 2 of the shielded cable 1, prevent the shielded cable 1 from slipping through the cable side connector 10, and make an electric connection between the outer housings 7 and 7' and the shielding member 2.

According to the present embodiment, an end portion 81 at which the cores 3 of the shielding member 2 are exposed is inserted into the outer metal housings 7 and 7' to obtain a stable low noise characteristic. That is, the cores 3 are not exposed outside the outer housings 7 and 7', and the high frequency current which is a noise source is bypassed by the capacitive coupling between the signal line 7 and the outer housings 7 and 7', thereby preventing radiation noise from being generated.

FIG. 16 shows the structure of the cable inlet 80 of the outer housings 7 and 7'. It practically shows the back of the cable inlet 80 with the upper outer housings 7 and the lower outer housing 7' coupled together.

In this case, the cable inlet 80 is formed to be a square such that each side of the square may be shorter than the diameter of the shielding member 2. Therefore, if the shielded cable 1 is put into the outer housings 7 and 7' with the position of the end portion 81 of the shielding member 2 maintained in the outer housings 7 and 7', then the shielding member 2 is deformed and connects the cable inlet 80.

Thus, by forming the cable inlet 80 such that one side of the inlet can be shorter than the diameter of the shielding member 2, and making the shielding member 2 surely connecting the cable inlet 80, the conductivity between the outer housings 7 and 7' and the shielding member 2 can be improved, and the shield effect of the outer housings 7 and 7' can be improved with a simple and less expensive configuration, thereby obtaining further reduced radiation noise.

(Ninth Embodiment)

Figure 17:
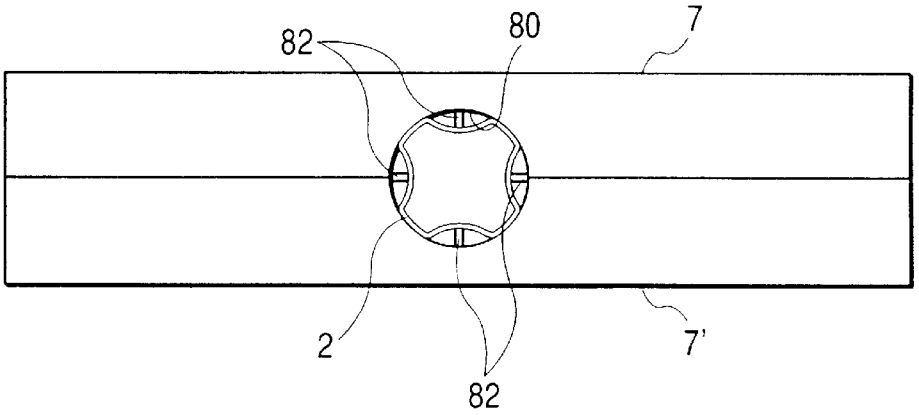
FIG. 17 is a back view of the configuration of the cable inlet portion of the shielded cable with a connector according to the ninth embodiment of the present invention.

FIG. 17 is a schematic sectional view of the structure of the connecting-portion between the outer housing of the shielded cable with a connector and the shielded cable according to the ninth embodiment of the present invention. It shows the back of the cable inlet 80 with the upper outer housings 7 and the lower outer housing 7' coupled together. The common or corresponding portions between the present and the eighth embodiments are assigned common reference numerals, and the explanation of them is omitted here.

According to the present embodiment, the cable inlet 80 has substantially the same diameter as the shielding member 2, and is provided with projections 82 extending inward. In this embodiment, there are four projections 82, but the number of the projection 82 is not limited so far as it is equal to or larger than one. If the shielded cable 1 is put into the outer housings 7 and 7' with the position of the end portion 81 of the shielding member 2 maintained in the outer housings 7 and 7', then the shielding member 2 is deformed by the projections 82, thereby having the outer housings 7 and 7' connected the shielding member 2 through the projections 82. By surely connecting the shielding member 2 with the cable inlet 80, the conductivity between the outer housings 7 and 7' and the shielding member 2 can be improved, and the shield effect of the outer housings 7 and 7' can be improved, thereby suppressing the radiation noise.

(Tenth Embodiment)

Figure 18:
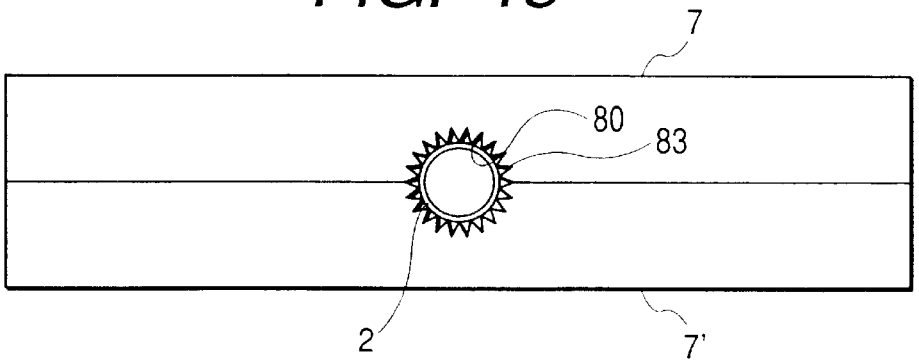
FIG. 18 is a back view of the configuration of the cable inlet portion of the shielded cable with a connector according to the tenth embodiment of the present invention.

FIG. 18 is a schematic sectional view of the structure of the connecting portion between the outer housing of the shielded cable with a connector and the shielded cable according to the tenth embodiment of the present invention. It shows the back of the cable inlet 80 with the upper outer housings 7 and the lower outer housing 7' coupled together. The common or corresponding portions between the present and the eighth embodiments are assigned common reference numerals, and the explanation of them is omitted here.

According to the present embodiment, the cable inlet 80 is designed to have a circular array of saw-teeth-shaped projections 83 and have substantially the same diameter as the shielding member 2. Therefore, if the shielded cable 1 is put into the outer housings 7 and 7' with the position of the end portion of-the shielding member 2 maintained in the outer housings 7 and 7', then the shielding member 2 in the outer housings 7 and 7' connects the cable inlet 80 at a number of points through the projections 83. Thus, the shielding member 2 can be surely connected to the cable inlet 80, the conductivity between the outer housings 7 and 7' and the shielding member 2 can be improved, and the shield effect of the outer housings 7 and 7' can be improved, thereby suppressing the radiation noise.

As described above, according to the shielded cable with a connector according to the present invention, the waveform of signals transmitted through the shielded cable 1 can be stabilized, and the noise emitted from the shielded cable 1 as an antenna can be constantly reduced at a lower level.

According to the present invention, since the shielded cable with a connector in which the connector whose conductive housing is divided into an inner housing and an outer housing is coupled to the end portion, the electric connection can be ensured between the inner housing and the outer housing with the connector fitted to and connected to the substrate side connector of the opposite side of the connection. Simultaneously, the deformation of the fitting portion of the inner housing to be fitted to the connector of the opposite side of the connection can be suppressed, and the electric connection to the connector of the opposite side of the connection can be stabilized. Thus, the transmission waveform of a signal can be stabilized when the signals are transmitted through a shielded cable, and the noise emitted from the shielded cable 1 as an antenna can be constantly reduced at a lower level.

Furthermore, according to the present invention, in addition to the stability of the electric connection between the inner housing and the outer housing, and between the inner housing and the connector of the opposite side of the connection, the conductivity between the connector housing and the shielding member can be improved by setting the end portion of the shielding member positioned inside the cable inlet of the back of the connector housing and electrically and directly connecting the cable inlet to the cable member at a number of points. Thus, all electric connections among members from the shielding members of the shielded cable to the housing of the substrate side connector of an electronic instrument can be completely made. As a result, the stable shield effect can be ensured, and the radiation noise can be reduced. In addition, in accordance with a simple and less expensive configuration, a signal line can be protected from the exposure to the outside of the connector housing, and the radiation noise from the shielded cable and the vicinity of the connector can be reduced by the capacitive coupling of the connector housing and the signal line.

Furthermore, with the configuration in which the cable inlet is formed to be a square such that the each side of the square is shorter than the diameter of the shielding member, and the cable inlet directly contacts the shielding member at a number of points for the conductivity, the shielding member can surely contact with the cable inlet, the conductivity between the connector housing and the shielding member can be improved, the shield characteristic of the connector housing can be improved by the simple and less expensive configuration, and the low radiation noise can be realized.

Furthermore, the cable inlet is formed such that its diameter can be substantially the same in size as the shielding member, one or more projections are provided on the edge of the cable inlet, and the cable inlet can directly contact to the shielding member and the conductivity can be made successfully. Therefore, the shielding member surely contacts with the cable inlet, the conductivity between the connector housing and the shielding member can be improved, the shield characteristic of the connector housing can be improved with a simple and less expensive configuration, and a low radiation noise can be obtained.

Additionally, with a saw-teeth shaped array of a number of projections is provided along the edge of the cable inlet, the shield structure and the cable inlet can contact with each other without fail, the conductivity between the connector housing and the shield structure can be improved, the shield characteristic of the connector housing can be improved with a simple and less expensive configuration, and lower radiation noise can be realized.

What is claimed is:

1. A shielded cable with a connector, in which the connector is connected to an end portion of said shielded cable formed by covering a plurality of cores with a shielding member, comprising:

an electrode portion provided having a plurality of electrodes connected to the plurality of cores;

a conductive inner housing having a fitting portion for fitting to another connector configured to be fitted to said connector, and having said electrode portion therein; and a conductive outer housing which, in combination with said inner housing, contains cores exposed from said shielded cable, wherein said outer housing is positioned such that an end portion of the shielding member is inside a cable inlet provided at a back of the outer housing, and a conductive clamp portion provided at a back end of the outer housing clamps the shielding member of the shielded cable to electrically connect;

wherein said outer housing is electrically connected to said inner housing through a conductive connecting portion elastically connected to the fitting portion of said inner housing; and wherein the cable inlet is formed to be a square such that the each side of the square is shorter than the diameter of the shielding member, and the cable inlet is electrically connected to the shielding member at a number of points.

2. The shielded cable according to claim 1, wherein the cable inlet is electrically connected to the shielding member at a number of points.

* * * * *

UNITED STATES PATENT AND TRADEMARK OFFICE

CERTIFICATE OF CORRECTION

PATENT NO. : 6,652,320 B2
DATED : November 25, 2003
INVENTOR(S) : Inagawa et al.

It is certified that error appears in the above-identified patent and that said Letters Patent is hereby corrected as shown below:

Column 3,
Line 33, “inner” should read -- inside --.

Column 10,
Line 33, “used only” should read -- used. Only --.

Column 13,
Line 22, “Therefore,” should read -- Therefore, since --.

Signed and Sealed this

Twenty-eighth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,652,320 B2
DATED : November 25, 2003
INVENTOR(S) : Inagawa et al.

It is certified that error appears in the above-identified patent and that said Letters Patent is hereby corrected as shown below:

Title page,
Item [56], References Cited, U.S. PATENT DOCUMENTS, -- 6,328,588 12/2001 Tsai et al. 439/352 -- should be added.

Signed and Sealed this

Tenth Day of May, 2005

JON W. DUDAS
*Director of the United States Patent and Trademark Office*